US005387115A

United States Patent [19]

Kozel et al.

[11] Patent Number: 5,387,115

[45] Date of Patent: Feb. 7, 1995

[54] ELECTRONIC SURFACE MOUNT MODULE SOCKET WITH EJECTOR LATCH

[75] Inventors: Charles Kozel, McHenry; Steven Hiller, Elk Grove Village; Joseph Ufheil, Chicago, all of Ill.

[73] Assignee: Methode Electronics, Inc., Chicago, Ill.

[21] Appl. No.: 73,168

[22] Filed: Jun. 7, 1993

[51] Int. Cl.[6] ..... H01R 13/629

[52] U.S. Cl. ..... 439/157; 439/83; 439/328; 439/636; 439/567

[58] Field of Search ..... 439/152–160, 439/83, 62, 325, 327, 328, 329, 567, 629–631, 636, 637, 566

[56] References Cited

U.S. PATENT DOCUMENTS

| | | | |
|---|---|---|---|
| 4,345,813 | 8/1982 | Hatch | 339/184 |
| 4,645,287 | 2/1987 | Olsson | 439/83 |
| 4,826,442 | 5/1989 | Douty et al. | 439/566 X |
| 4,902,239 | 2/1990 | Schindler | 439/157 |
| 4,975,073 | 12/1990 | Weisman | 439/157 |
| 4,995,825 | 2/1991 | Korsunsky et al. | 439/328 |
| 5,052,936 | 10/1991 | Biechler et al. | 439/630 X |
| 5,074,800 | 12/1991 | Sasso et al. | 439/157 |
| 5,120,256 | 6/1992 | Walden | 439/566 X |
| 5,139,430 | 8/1992 | Lewis et al. | 439/157 |
| 5,162,002 | 11/1992 | Regnier | 439/637 |
| 5,163,847 | 11/1992 | Regnier | 439/157 |
| 5,207,598 | 5/1993 | Yamada et al. | 439/157 |

FOREIGN PATENT DOCUMENTS

| | | | |
|---|---|---|---|
| 9302491 | 2/1993 | WIPO | 439/629 |

*Primary Examiner*—Steven C. Bishop
*Attorney, Agent, or Firm*—David L. Newman

[57] ABSTRACT

A electronic module socket for interconnecting an electronic module to a circuit board includes an insulative housing having an elongated central cavity having multiple formed tuning fork contacts to provide electrical connection and retain an electronic module within the central cavity. The contacts include a contact end which extends transversely from the socket and engages conductive members of a circuit board for surface mounting of the socket thereon. The socket includes a latch to provide a locking and an ejector mechanism for an electronic module.

7 Claims, 2 Drawing Sheets

ELECTRONIC SURFACE MOUNT MODULE SOCKET WITH EJECTOR LATCH

BACKGROUND OF THE INVENTION

The present invention relates to an electrical connector or socket for establishing an interconnection with an electronic module and more particularly to a low insertion force socket providing in-line insertion and is board mountable having an ejector latch for securing and ejecting an electronic module, such as a single in-line memory module (SIMM).

Electronic module sockets for mounting SIMMs are known in the art, such as Korsunsky et al., U.S. Pat. No. 4,995,825, which describes a socket for interconnecting an electronic module to a circuit board including an insulative housing having a plurality of contacts applying a moment to the module, and a U-shaped latch positioned within a pocket at each end of the insulative housing to hold the module securely within the housing after rotation to an upright position. A problem with such SIMM sockets is the requirement for two motions to insert the SIMM which is timely and requires more spacing between the sockets to rotate the SIMM to an upright position.

Also, the Korsunsky et al. patent discloses through board soldering, wherein the contact leads are inserted through holes in the circuit board and then soldered from the bottom of the circuit board. Such a mounting process is a timely, difficult process which is difficult to inspect. Another problem is that insertion of the SIMM into the socket requires two morons. Namely, the SIMM must be placed at the base of the socket and then rotated forward into an upright position. This induces critical stresses to solder joints, the plastic housing, and to the metal and/or plastic latches of current SIMM socket connector design.

In-line board insertion and extraction which allows insertion of a module via a single motion in one plane, vertical, horizons, etc., eliminates the stresses that are induced in today's SIMM connectors in which boards are seated at an angle and rotated or cannot into place. Also, to release the SIMM from the socket requires releasing the latch with a screwdriver or some other long pointed instrument and once the SIMM is released from the latch by canting it at an angle, using fingers to grab the narrow edge of the SIMM to remove it from the socket. When the sockets having the SIMMS inserted in them are lined up one next to the other, it is very difficult to release the latch or to grab the top thin portion of the SIMM in order to remove it. Current SIMM connector design prevents tight board spacing because of the angled board insertion. In-line board insertion/extraction allows for greater board density because connectors can be spaced closer.

Current SIMM designs also have stamped or blanked tuning fork contact geometry which cause non-uniform and unevenly distributed loading on boards that induces unnecessary stresses to the board. The concept of a formed tuning fork contact geometry provides a larger contact wipe, less wear, and a uniformly distributed normal force load on the board pad interface. The formed tuning fork contact concept, instead of the blanked contacts of current design, provides a smooth contact surface versus the shear and break-edge of a blanked contact for wear, a larger contact wipe for better electrical integrity, and uniform normal force loading on pads of SIMM modules that reduce stresses on both board and connector.

Surface-mount electrical connectors are becoming more common and desirable in the electronics industry because of their ease of assembly and inspection. Surface-mount is accomplished where pads are provided on the surface of a circuit board by screening on solder paste in the desired contact areas. After placement of a connector or in particular an electronic module socket, wherein the contact ends of the socket are in contact with the pads, the soldering is activated by increasing the temperature of the pad, paste and lead assembly, which causes a secure connection to occur between the circuit board and the socket via the contact ends. A common means of heating the soldering paste is exposure to an Infrared (IR) source. The heating process is accelerated by increased exposure of the assembly to the IR source. Thus, a contact point which is directly exposed to the IR source will cure more quickly than a contact point which is concealed under a connector or socket out of direct exposure to the IR lightwaves.

Surface-mounting also allows for quick inspection of the mounting process to see that it was successful for each and every contact point. Instead of having to turn the circuit board over, as was required for through board mounting, inspection may be accomplished by viewing the top of the circuit board. Inspection is also made easier where the contact points are open and out from under connectors or sockets enabling viewing from above.

By this invention, an electronic module socket is provided which allows for the insertion of a SIMM into a socket with one movement, in-line into the socket.

It is another object of the present invention to provide a new and improved electronic module socket which is surface-mountable onto a printed circuit board allowing for quick mounting.

It is a further object of this invention to provide a new and improved electronic module socket which provides an ejector latch which will securely retain and quickly and easily eject an electronic module from the socket.

It is another object of the present invention to provide a new and improved electronic module socket which allows for maximum IR penetration for surface-mounting the socket on a circuit board.

It is a further object of the present invention to provide a new and improved electronic module socket which allows for quick inspection of surface-mount after soldering has occurred.

It is still another object of the present invention to provide a new and improved electronic module socket which includes multiple manufactured formed tuning fork contacts which are easily inserted into the insulation of the socket, are efficiently produced, and provide a large and smooth wipe area and long endurance.

It is another object of the present invention to provide a new and improved electronic module socket which includes securement (housing retention) members which provide socket retention and location prior to IR surface mount soldering operations; and when combined with a right angle tab, to provide strain relief to the solder joints of the surface mount tail during board insertion and extraction.

SUMMARY OF THE INVENTION

An electric module socket interconnects an electronic module to a circuit board comprising an insulative housing containing a plurality of contacts for connection with a printed circuit board and resilient retaining means for holding the module within the housing. An ejector latch 15 is pivotally mounted at each end of the housing having a locking mechanism and having a camming surface to accept the bottom comer surface of the module and to eject the same upon pivoting of the latch forcing the camming lever upward against the bottom of the module. The pivoting movement of the latch is caused by the outward pressure of a finger on the latch head.

A socket for interconnecting a single in-line memory module to a circuit board comprises an elongated insulative housing. The housing includes an elongated central cavity for receiving an electronic module. The central cavity includes a plurality of opposed points of contacts located along both sides of the central cavity. The contacts are configured to establish electrical contact with the electronic module upon vertical insertion of the electronic module within the central cavity. In-line board insertion/removal, instead of inserting at an angle and camming a board in place, provides lower internal stresses to connector construction and solder joints while providing tighter connector packaging for greater printed board density. The contacts each define a first and second section. The first and second section of the contact reside within the central cavity and exert frictional force against the electronic module upon insertion into the central cavity. The frictional force is sufficient to retain the electronic module within the central cavity. The contacts also each define a third contact section. The third contact sections are positioned exterior to and at the base of the socket. The third contact sections engage conductive members of a circuit board when the socket is carried thereon. The third contact sections further define a contact end which extends transversely of the socket for surface mounting. Surface mount of contact ends instead of dip solder tails eliminate the wave soldering process. The present invention may be provided having contact ends having either surface mount tails or dip solder tails for through board soldering.

In a preferred embodiment, the contacts are stamped and formed, or formed in a tuning fork geometry, as opposed to blanked contacts. Formed contacts provide more efficient material usage, gang loading of an infinite number of contacts as a unit within the insulation of a socket, longer and smoother contact wipe and greater endurance and repeatability for multiple insertions of an electronic module. Due to the in-line insertion and formed contacts, uniform beam lengths of the contacts are achieved to also provide long contact wipes and more reliable contact than traditional rotated insertion modules which require offset contact pairs.

The housing also includes a latch means positioned at the ends of the central cavity. The latch means is pivotally mounted on the housing for movement between a latched position and an eject position. The latch means includes an actuating portion for moving the latch from a latch position to an eject position. The latch includes a detent which locks the electronic module within the socket by frictionally engaging a hole at the edge of the electronic module when the catch means is rotated toward the electronic module from the eject position into the latch position. The detents secure the electronic module within the socket and limit the lateral and vertical movement of the electronic module upon its insertion in the central cavity. The latch means further includes a camming surface which is positioned at the base of the catch means. The camming surface exerts an upward pressure at the base of the electronic module when the latch means is moved from the latched position to the eject position causing the ejection of the electronic module for easy removal from the socket. The camming surface also contacts the base of the electronic module upon insertion of the electronic module into the central cavity. The insertion of the electronic module into the central cavity provides a downward pressure on the camming surface which causes the latch to rotate from the eject position to the latched position. Cam-actuated plastic latches, instead of plastic or metal locking clips, provides more uniform board insertion and extraction while reducing the high torsioning stresses induced by earlier designs.

The housing further includes securement members which are positioned at each end of the socket. The securement members protrude downwardly from the bottom of the socket. The securement members are inserted into a circuit board and secure the socket to the circuit board to prevent vibration or loosening of the socket. In a preferred embodiment, the securement member also includes an enlarged right-angle surface mount tab to provide for strain relief for the contact ends of the socket.

In accordance with the preferred embodiment of the invention, the contact ends protrude from the base of the socket and extend laterally from the side of the socket exposing the contact ends from a perpendicularly upward and side horizontal direction allowing for visual inspection of the contact ends for a proper surface-mount.

In accordance with another preferred embodiment of the invention, stand-offs are provided at the base of the socket. The stand-off includes an enlarged protection barrier which protrudes down from the base of the socket an equal distance as the exposed contact ends to protect the contact ends from damage during shipping of the socket.

The foregoing and other objects and advantages of our invention will be apparent from the following description of a preferred embodiment thereof, taken in conjunction with the accompanying drawings.

Figures 1, 2, 3:
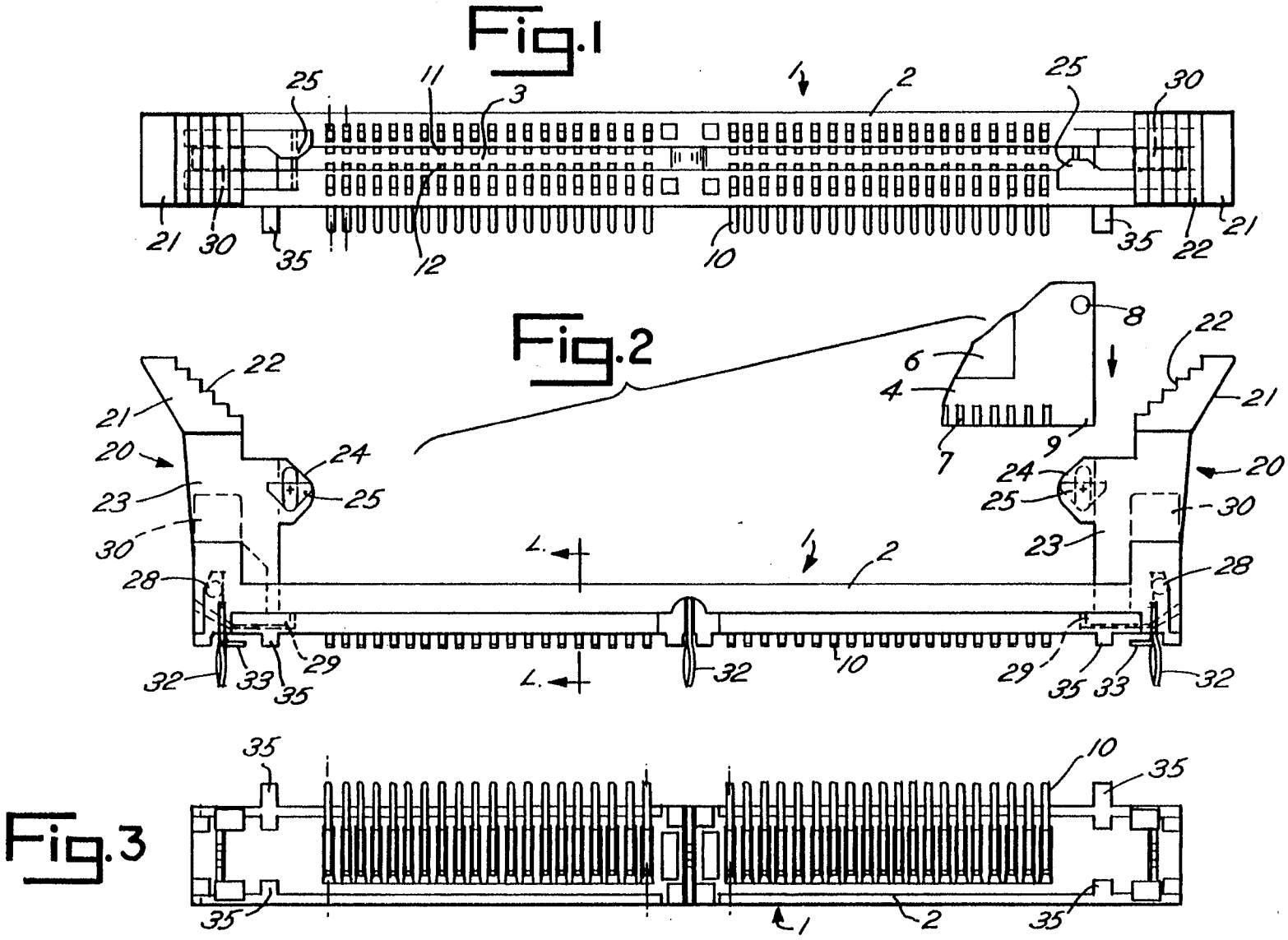
FIG. 1 is a top view of the socket of this invention.
FIG. 2 is a side elevation view of the socket of this invention.
FIG. 3 is a bottom view of the socket of this invention.

Now, in order to acquaint those skilled in the art with the manner of making and using our invention, there will be described, in conjunction with the accompanying drawings, a preferred embodiment thereof.

DETAILED DESCRIPTION OF THE INVENTION

Referring to the drawings in greater detail, and first to FIGS. 1–3, the invention is directed to a surface mounted electronic module socket with ejector latch, described below, for use in general with a single in-line memory module (SIMM). The socket 1 is generally formed of an insulative housing 2 which includes a center cavity 3 which runs axially through the center of the socket (FIG. 1) for accepting a SIMM 4. Each SIMM 4 comprises a circuit panel generally having a plurality of integrated circuit components 6, contact segment 7 and a hole 8. These SIMMs are normally manufactured in accordance with JEDEC standards.

The housing 2 comprises a plurality of contacts 10 positioned therein. The insulative housing 2 comprises a one-piece molded member formed from a suitable insulative material. A liquid crystal polymer can be used to mold the insulative housing 2 or other materials such as polyphenylene sulfide may be used. The contacts 10 are inserted into the insulative housing 2 to intersect the central cavity 3 in order to provide opposed points of contact surfaces to interconnect the contact segments 7 of the SIMM 4 to a printed circuit board upon which the socket 1 is mounted.

Located at the ends of the socket are ejector latches 20. The latch 20 includes a head 21 having a grooved finger-tip gripping actuating surface 22, and a body 23 having an inwardly protruding tab 24, including a detent 25 projecting perpendicular to the body 23. The latch 20 is pivotally hinged on a pin 28. The latch 20 has a camming surface or toe 29 protruding at its base. The latch 20 is shown in FIG. 2 in its latched position in which a SIMM would be latched and rigidly contained within the socket 1. In its latched position, the latch 20 is in a vertical orientation and pivoted inwardly so that the base of the latch 20 and a toe 29 abuts against the base of the interior of the socket 1, restricting further inward movement of the latch 20. In the latched position, the corner 9 of a SIMM 4 rests upon the toe 29 of the latch 20 and detent 25 engages the hole 8 of the SIMM 4 providing for the secure positioning and locking of the SIMM 4 within the socket 1. The detent 25 engaged within the hole 8 prevents the SIMM 4 from any lateral or vertical movement within the central cavity 3 of the socket 1 mounted so that the central cavity 3 is vertical.

The SIMM 4 reaches its secured position within the central cavity 3 and forces the latch 20 into its latched position by the insertion force of the SIMM 4 against the toe 29 of the latch 20. By the force of an operator pushing the SIMM 4 in-line or vertically down into the central cavity 3, the frictional force of the bottom corner 9 of the SIMM 4 against the toe 29 of the latch 20 forces the latch 20 inward from its eject position to its latched position. An alternative embodiment may provide the socket 1 mounted on its side so that in-line insertion is in the horizontal plane. Upon complete insertion of the SIMM 4 into the central cavity 3, the detent 25 of the latch 20 is forced to engage the hole 8 of the SIMM 4.

Ejection of the SIMM 4 is accomplished by an operator putting downward and outward pressure on the actuating surface 22 of the latch 20 in order to pivot the latch outwardly from its latched position to the eject position. Pressure at the actuating surface 22 simultaneously causes the detent 25 to disengage from the hole 8 of the SIMM 4 and forces the toe 29 of the latch 20 to frictionally contact the lower corner 9 of the SIMM 4 in an upward direction causing the SIMM 4 to move vertically upward and out of the central cavity 3, thereby ejecting the SIMM 4 from the socket 1. By ejecting the SIMM 4 from the socket 1 by pressing on the actuating surfaces 22, an operator does not have to attempt to grab the top edge of the SIMM 4 which may be located in between other sockets having SIMMs inserted therein providing a narrow space for fingers to grasp. By this invention, and by use of the ejector latch 20, the SIMM 4 is ejected above the densely spaced and surrounding SIMMs so that an operator may easily grab the upper edge of the SIMM 4 for complete removal from the socket 1.

Figure 5:
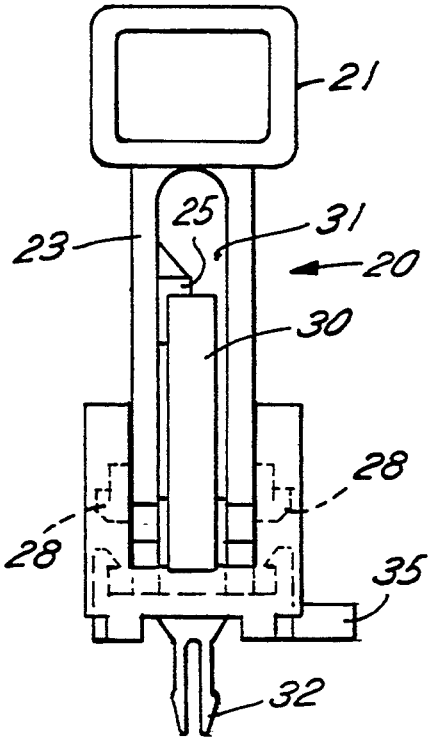
FIG. 5 is a side elevation view of the side of the socket of this invention.

The latch 20 straddles an end wall 30 (see FIG. 5). The end wall 30 is located at either end of the central cavity 3 and restricts the SIMM 4 from axial movement within the central cavity 3 after being inserted therein. The body 23 of the latch 20 includes a central cavity 31 which allows the latch 20 to pivot from its latched position to its eject position while straddling the end wall 30.

The socket 1 also includes securement members 32 which protrude downwardly from the bottom of the socket 1 and are inserted into holes in a printed circuit board to secure the socket 1 thereon. In a preferred embodiment, three (3) securement members 32 extend from the base of the housing 2. The securement members 32 are stamped and formed to allow for a bi-direction insertion into the circuit board that centrally aligns the securement members 32 with the through hole in the circuit board allowing for optimum alignment of surface mount tails to the surface mount pads of the circuit board. In a preferred embodiment, the securement member 32 also has integral to it an enlarged right-angle surface mount tab 33. The enlarged right-angle surface mount tab 33 has a greater surface area than the contact ends 10 and is surface mounted to a solder pad of a printed circuit board in order to provide strain relief for the other contacts 10 which are surface mounted as well.

Stand-offs 35 protrude from the base of the socket 1 and provide for stable contact areas upon which the socket sits on a printed circuit board. The stand-offs 35 may also provide for open areas under the socket 1 for washing. The stand-offs 35 also provide an enlarged protection barrier which protrudes down from the base of the socket equidistant to the contact ends 10 (see FIG. 4) in order to protect the contact ends 10 from damage during shipment of the socket 1.

Turning to FIG. 3, in particular, a preferred embodiment is shown in which contact ends 10 protrude only from one side of the socket 1. This arrangement provides a single read-out contact in which a single signal is received from two contact segments 7 on opposite sides of a SIMM 4.

Figure 4:
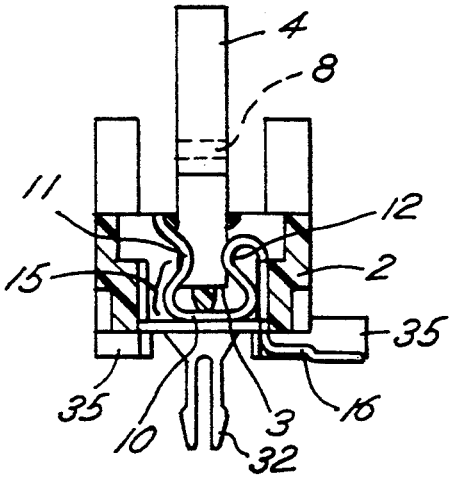
FIG. 4 is a cross-sectional view of the socket of FIG. 2 taken at the L—L of FIG. 2.

Turning to FIG. 4, a formed contact 10 is shown having a first section 11 and a second section 12. The first and second sections 11, 12 of the contact 10 reside within the central cavity 3 and contact the contact segments 7 on both sides of the SIMM 4 and exert frictional force against the SIMM 4 upon insertion into the central cavity 3. In a preferred embodiment, the first and second sections 11, 12 of the contact 10 are shaped in a geometry referred to as a tuning fork geometry. The first and second sections 11, 12 oppose each other on opposite sides of the central cavity 3 and protrude at the first and second sections 11, 12 forming the tuning fork geometry and providing for a point of frictional engagement of the SIMM 4 upon insertion into the central cavity 3. The contacts are resiliently deflectable to allow insertion of the SIMM 4. The first and second sections 11, 12 provide for a large wipe area where the contact segments 7 on both sides of the SIMM 4 come into electrical contact with the first and second sections 11, 12 of the socket 1. The wipe area of the formed contacts 10 of this invention provide a larger wipe area, due to the forming process, than the stamp and formed contacts of prior art electronic module sockets.

Figure 6:
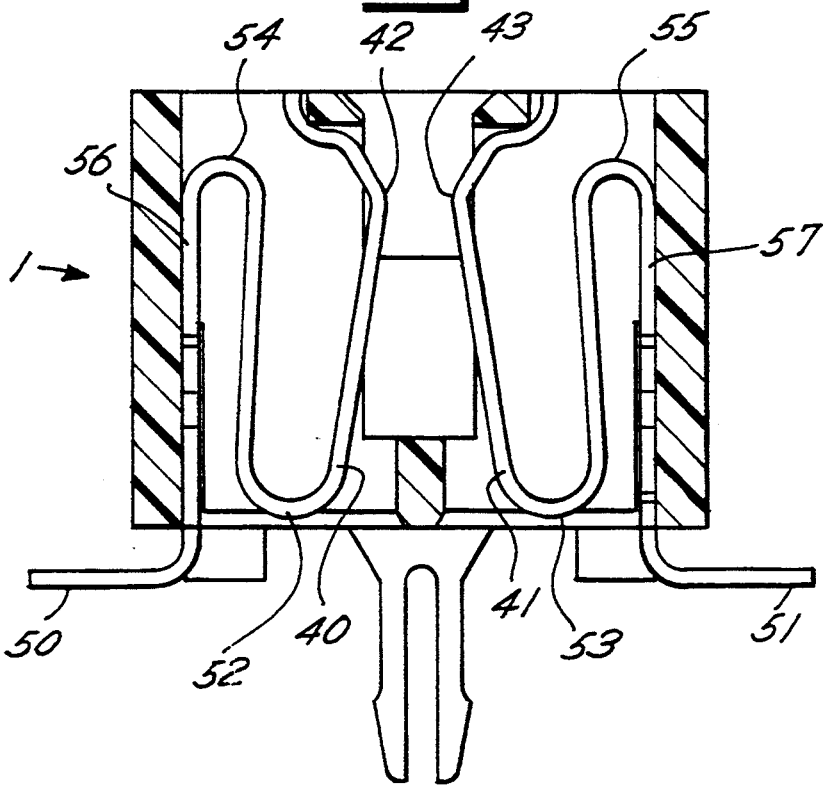
FIG. 6 is a cross-sectional view of an alternative embodiment of the present invention.

The tuning fork geometry of the contacts 10 provides for a single read-out configuration in which a single signal is transmitted 19 both sides of contact segments 7 of the SIMM 4, and received on one side of the SIMM 4 by the first section 11 and on a second side of the SIMM 4 by the second section 12 and the same signal is received at the contact end 10 as a single read-out. An alternative embodiment of the present invention also includes a dual read-out socket (FIG. 6).

The present invention, due to the completely in-line insertion achieved by the latching mechanism, described above, allows for the first section 11 and the second section 12 of the contacts 10 to be positioned generally opposite each other and having uniform beam lengths 15 to provide a more reliable contact and a more uniform frictional engagement of the SIMM 4 than prior art electronic module sockets which had SIMMs which were placed into a central cavity and rotated into position, requiring offset contact points.

The formed contacts 10 of this invention are manufactured in multiple configurations located uniformly along a carder strip. The multiple contacts 10 are then inserted into the insulation material 2 of the socket 1 via a process of gang loading wherein all the contacts of the entire socket 1 are loaded simultaneously. This method is achieved due to the formed contacts, which save assembly time over the prior art methods which have blanked contacts in which each individual contact must be inserted separately into the insulation of the socket 1.

The contact 10 comprising a convolute, d, elongated, linear, conductive metal member also includes a third contact section 16 or contact end which forms the contact end which extends horizontally from the base of the socket 1. The contact end 16 is positioned on a solder pad of a printed circuit board and provides electrical connection between the contact 10 and the circuit board. By heating the soldering paste on the pad, such as by exposure to an infrared (IR) source, the contact 10 is connected to the printed circuit board. The extension of the contact end 16 beyond the insulation 2 of the socket 1 allows direct penetration of IR and allows for inspection of the solder and a positive contact being made. The inspection of the single socket 1 surface mounted to a printed circuit board, may be made perpendicularly above the socket 1 or from the side of the socket 1 from a horizontal view looking from the side where the contact end 16 protrudes. However, when multiple sockets are surface mounted to a printed circuit board side-by-side, inspection may still be achieved by looking perpendicularly down between the sockets in order to see the extended contact end 16 and the positive contact made and attachment with the solder paste.

Turning to FIG. 5, a side elevation view of the socket 1 is shown from the side in which the latch 20 is shown having a head 21, a body 23 and a central opening 31. The latch pivots about the pin 28 and straddles the end wall 30. The detent 25 extends perpendicular from the body 23 to engage the hole 8 of the SIMM 4. At the base of the socket 1, stand-offs 35 provide a surface for the socket 1 to make contact to a printed circuit board. Securement members 32 protrude downwardly from the bottom of the socket 1 to be inserted into holes in a printed circuit board to secure the socket 1 thereon.

Turning to FIG. 6, an alternative embodiment of the present invention is shown in cross-section showing a dual read-out socket having contact leads 50, 51 protruding from both sides of the socket 1. The general shape of the contacts 40, 41 may be referred to as an inverse bellows configuration which provides the dual read-out function as opposed to the tuning fork configuration (FIG. 4) which provides a single read-out function. Two independent contacts 40, 41 transmit two independent signals received from opposite sides of the SIMM 4 inserted into the socket 1 having contact segments 7 located opposingly on the SIMM 4. A signal from one side of the SIMM 4 is received by first wipe area 42 of the contact 40 and finally received by the contact end 50 which is transmitted to a pad on a printed circuit board to which the socket 1 is mounted. The contact 40 includes a bottom support area 52 and a top section 54 which is integral with an outer side 56. The configuration of the contact 40 provides for a securely inserted contact within the insulation of the socket 1 while providing a resilient upwardly projecting first wipe area 42. Likewise, the contact 41 receives a signal from the second side of the contact segment 7 of a SIMM 4. The signal is received at a second wipe area 43 of the contact 41 and finally received by contact end 51 and transmitted to a printed circuit board. The contact 41 likewise includes a bottom support area 53 and a top section 55 which is integral with an outer side 57.

The description above has been offered for illustrative purposes only, and it is not intended to limit the scope of the invention of this application which could have alternative embodiments defined in the following claims.

We claim:

1. An electronic module socket for interconnecting an electronic module to a circuit board, the electronic module socket comprising:

an elongated insulative housing including, an elongated central cavity for receiving an electronic module having, a plurality of opposed contacts located along both sides of said central cavity configured to establish electrical contact with said electronic module upon insertion of said electronic module within said central cavity;

said contacts each defining a first and second section which resides within said central cavity exerting frictional force against said electronic module upon insertion, sufficient to retain said electronic module in said central cavity, said contacts also each defining a third contact section positioned exterior and transversely to the base of said socket to engage conductive members of a circuit board when said socket is carried thereon;

said third contact section extending beyond the side of said socket, whereby said third contact sections are exposed in the upward perpendicular direction while the socket is carded on a circuit board;

said housing includes a latch means positioned at each end of said central cavity, pivotally mounted on said housing for movement between a latched positioned in which support is provided for said electronic module upon insertion, and an eject position in which said electronic module is ejected from said socket;

said latch means includes an actuating surface for moving the latch from said latched position to said eject position and a detent which locks said electronic module by frictionally engaging said electronic module when said latch means is rotated toward said electronic module from said eject position to said latched position, said detents limiting movement of said electronic module upon insertion in said central cavity;

said latch means includes a camming surface positioned at the base of said latch means for exerting upward pressure at the base of said electronic module upon movement of said latch from said latched position to said eject position to eject said electronic module, and said base of said electronic module to contact said camming surface upon insertion of said electronic module in said central cavity providing downward pressure on said camming surface to rotate said latch from said eject position to said latched position;

said housing includes enlarged right-angle tabs positioned exterior and transversely to the base of said socket to engage solder pads of a circuit board; and said right angle tabs being integral with a securement member.

2. The electronic module socket of claim 1, wherein: said contacts are tuning fork contacts stamped and formed.

3. The electronic module socket of claim 2, wherein: said contacts each comprise a convoluted, elongated, linear, conductive metal member said first and second sections being separated from each other by a U-shape base section.

4. The electronic module socket of claim 1, wherein: said securement member protrudes downwardly from said socket for insertion into said circuit board, securing said socket to said circuit board.

5. The electronic module socket of claim 1 wherein: said housing includes stand-offs projecting downwardly from the base of said socket providing contact areas to support said socket on said circuit board.

6. The electronic module socket of claim 4 wherein: said stand-offs project equidistantly from said base as said contacts in order to provide protection of said contacts.

7. The electronic module socket of claim 1 wherein: said contacts are gang loaded within said housing.

* * * * *